US005374033A

United States Patent [19]

Tilman

[11] Patent Number: 5,374,033

[45] Date of Patent: Dec. 20, 1994

[54] SPREADING OR LIFTING DEVICE

[76] Inventor: Paul L. Tilman, 59, rue Sainte Anne, B-4460 Grace-Hollogne, Belgium

[21] Appl. No.: 958,360

[22] PCT Filed: Feb. 11, 1992

[86] PCT No.: PCT/BE92/00003

§ 371 Date: Dec. 14, 1992

§ 102(e) Date: Dec. 14, 1992

[87] PCT Pub. No.: WO92/14674

PCT Pub. Date: Sep. 3, 1992

[30] Foreign Application Priority Data

Feb. 14, 1991 [BE] Belgium ..... 09100143

[51] Int. Cl.[5] ..... B66F 3/00

[52] U.S. Cl. ..... 254/104

[58] Field of Search ..... 254/109, 93 R, 120, 254/124; 72/705; 144/193 A, 193 C, 193 D, 366; 29/252, 239, 253

[56] References Cited

U.S. PATENT DOCUMENTS 2,657,904 11/1953 Evenson ..... 254/104
3,738,603 6/1973 Arnett ..... 254/104
4,299,347 11/1981 Rougier ..... 254/104

*Primary Examiner*—Robert C. Watson
*Attorney, Agent, or Firm*—Fishman, Dionne & Cantor

[57] ABSTRACT

Device comprising a wedge-shaped lower part; both sloped faces of the wedge are covered by a channel, the lower face of which is in contact with the corresponding sloped face of the wedge that it covers; the wedge is driven between the two channels toward the items to be separated or the work-piece to be lifted; the channels are linked to the driving system of the wedge by connecting rods comprising articulation pivots; elastic means maintain the channels in contact with the sloped faces of the wedge.

15 Claims, 3 Drawing Sheets

SPREADING OR LIFTING DEVICE

The object of the present invention is a spreading device—more specifically a lifting device—permitting the spreading or lifting of work-pieces, particularly when they present a very reduced space between the bearing surfaces.

Besides the traditional levers used for spreading parts or for lifting work pieces, spreaders comprising jaws articulated by a ram are well known; given the thickness that these jaws must have to withstand large forces, such spreaders are usable only if there is sufficient space between the two bearing surfaces. In light of their design, they permit the lifting of only small loads at the tip of the jaws.

The following description of the invention relates to the case of its application for lifting work-pieces; this is, however, only a particular case, inasmuch as the device may also be used to increase the distance between two adjacent items.

The present invention consists of a device capable of both lifting heavy pieces and being usable even when the space between the bearing surfaces (e.g., the floor and the piece to be lifted) is small.

The operating principle of the invention device resides in driving a wedge between the two bearing surfaces, which facilitates the penetration by the presence of two sliding surfaces.

The annexed drawings, given purely for illustration and not to scale, show the invention device to provide an easy understanding of the construction and the operation.

Figure 5A:
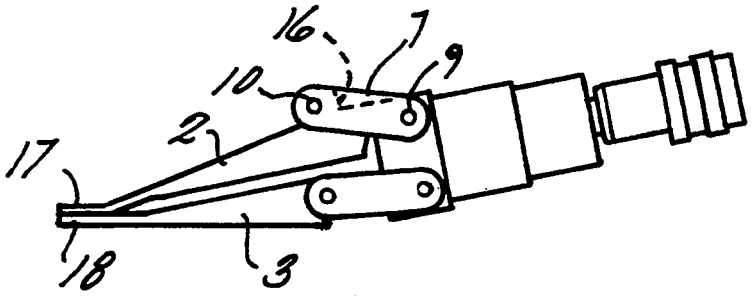
Figure 5B:
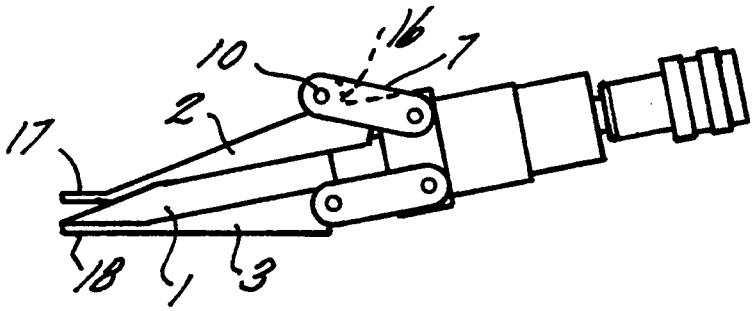

FIGS. 5A and B are elevational views of the device wherein FIG. 5A is at its starting position and FIG. 5B is at its lifting position.

On all of the figures the same components are noted by the same reference numbers.

Figure 1:
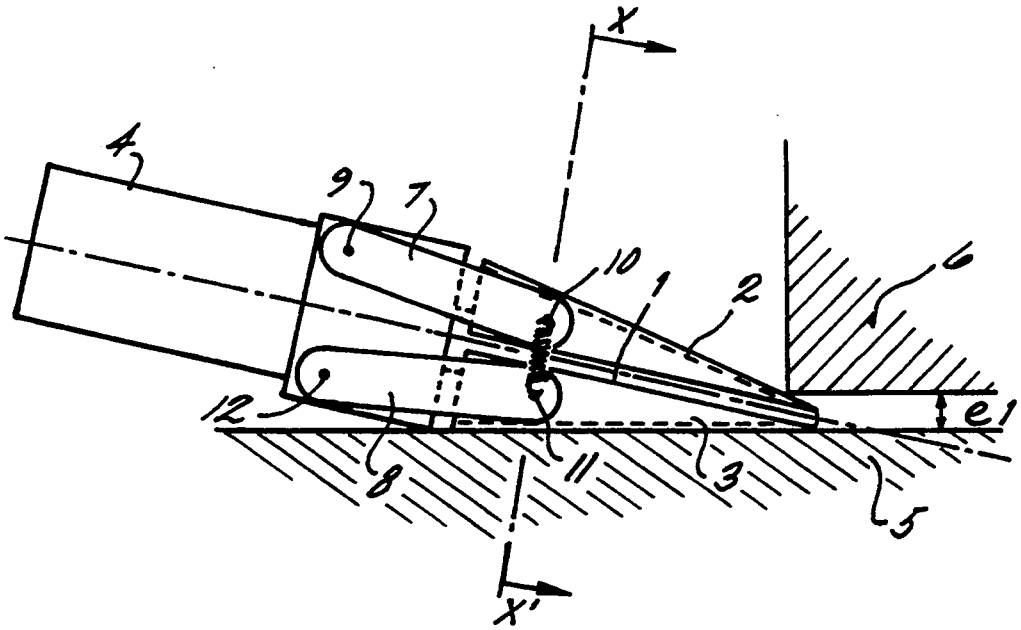
FIG. 1 is an elevational view of the device in its starting position, i.e., at the moment when it is going to be used to lift a work-piece.

In FIG. 1 the wedge 1, which constitutes the central component of the device, can be seen; on either side of the wedge, in contact with its plane sloped parts, there are two channels 2 and 3, the inside faces of which, also planes, serve as sliding surfaces at the wedge; a means 4 of driving the wedge (for example, a hydraulic ram) is located at the rear of the wedge to ensure the penetration of the latter into the space situated between the floor 5 and the piece to be lifted 6; the starting height e1 of the space is small. The ram 4 and the channels 2 and 3 are linked by means of connecting rods 7 and 8, which prevent any travel of the channels under the thrust of the ram, and which also permit the spreading or closing of said channels with respect to each other by rotation around the articulation pivots 9, 9' 10 and 10'.

Even when the device is not active, the two channels 2 and 3 are maintained in permanent contact with the wedge 1 by means of such components as the extension springs between the articulation pivots 10, 11, 10' and 11'.

Figure 2:
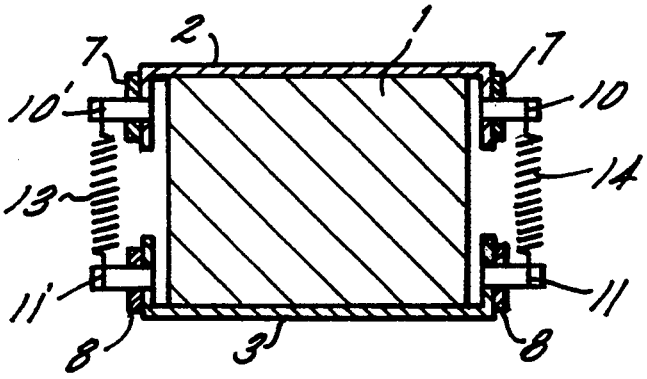
FIG. 2 shows a cross-section of the device.

In FIG. 2, which shows a cross-section of the device at the location of articulation pivots 10 and 11, the wedge 1 and the channels 2 and 3 can be clearly distinguished. The inside plane-faces of said channels are in contact with the sloped plane-faces of the wedge. The articulation pivots are fixed to the sides of the channels 10, 10' 11 and 11' to permit the rotation of connecting rods 7, 7' and 8 8'. The springs 13 and 14 keep the channels in contact with the wedge 4.

Figure 3:
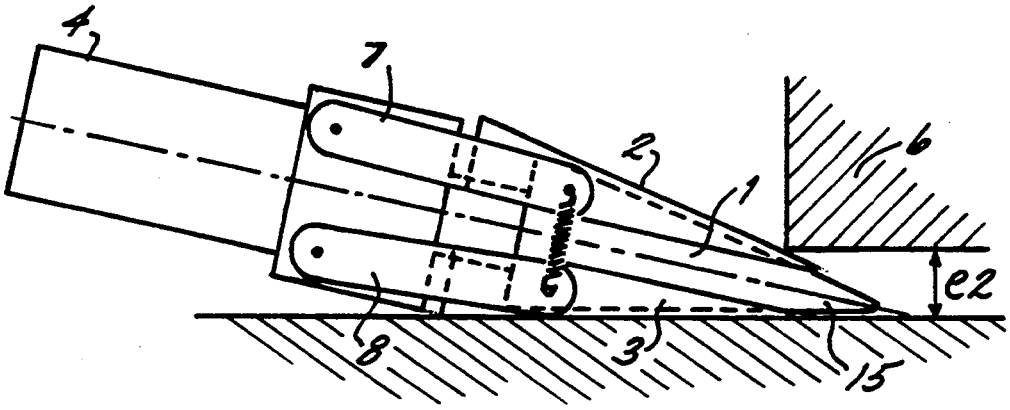
FIG. 3 is an elevational view of the device when the final height of the piece to be lifted is reached.

FIG. 3 shows an elevational view of the invention when the ram 4 has driven the wedge 1 into the space—maintaining the height e2—between the floor and the piece to be lifted; it can be seen that the tip 15 of the wedge has exited from its housing between the two channels, and that channel 2, which is not in contact with the floor, has separated from channel 3 without breaking the contact between the sliding surfaces of the wedge and the channels, by reason of the play of connecting rods 7 and 8 which permitted movement toward the top of channel 2.

Figure 4:
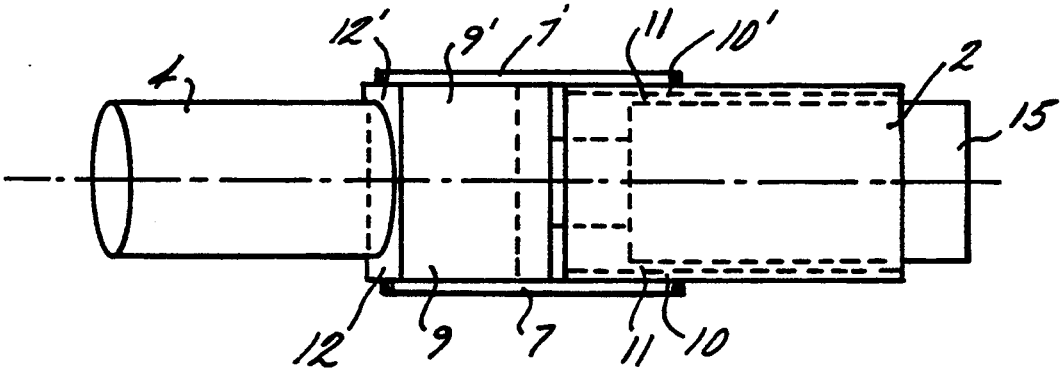
FIG. 4 is a plan view.

In FIG. 4, which shows an overall diagram of the invention in action after lifting, corresponding to FIG. 3 (wedge tip out), it is again possible to distinguish the tip 15 of the wedge, and the channel 2 linked to the ram 4 by connecting rods 7 and 7' said rods being able to withstand a rotation around the articulation pivots 10 and 10' on the one hand and 9 and 9' on the other.

The description of the invention illustrated by the above figures permits an easy understanding of the operation of the device.

Under the pressure of a hydraulic ram, for example, having a capacity of 5 tons, single-acting ram with extension spring, actuated by a manual or other type of hydraulic pump, the wedge travels by spreading the two channels held by the connecting rods and enters into the reduced space permitting the lifting of the apparatus. The two channels permit very accurate raising of the work-piece while preventing its lateral displacement. To lower the piece it suffices to release the ram pressure: the wedge withdraws under the effect of the extension spring, and the two channels approach each other.

The angle and length of the wedge may be determined as functions of the application.

With a simple 5-ton ram the lifting force can reach 12 tons, but the invention also permits using other more powerful or double-acting rams.

Advancement of the wedge can also be accomplished mechanically with a screw. The 2 channels can be maintained in contact with the wedge, between the pivots which hold the bearing channels to the connecting rods, by springs secured to the screws; however, any other method of securing (e.g. rubber rings) may also be used.

The outside faces of the bearing channels may be striated or grooved, in order to increase adherence with the floor or the piece to be lifted.

Having described the invention device, it is now easier to bring out the characteristics.

The spreading-device, and more particularly the lifting-device, object of the present invention, is thus essentially characterized in that it comprises a wedge-shaped internal part, both sloping faces of said wedge each being covered by a channel, the inside face of which is in contact with the corresponding sloped face of the wedge that it covers; a system of driving the wedge between the two channels toward the components to be spread or the piece to be lifted; and a means of linking the channels to the driving system of the wedge, comprising articulation pivots of the channel around an axis parallel to the plan of the sloped faces of the wedge. According to an advantageous application of the invention, the device also comprises an elastic means to hold the channels in contact with the sloped faces of the wedge.

In FIGS. 5A and B an interesting variation on the device, the articulation pivots 10, 10 of the upper channel 2 can be secured either in the sides of the channel 2 or in an integral housing 16 located above this channel 2. In this latter arrangement, vertical travel of the upper channel 2 —and hence of the load—is ensured. The channels 2 and 3 may be advantageously extended by tip-shaped plane sections 27 and 18, thereby providing protection for the wedge 1 during its travel.

I claim:

1. A device comprising:

a wedge-shaped internal pan, both sloped faces of said wedge being covered by a U-shaped sheet, the internal face of which is in contact with the corresponding sloped face of the wedge that it covers;

means for driving the wedge between the two U-shaped sheets toward the items to be separated or the work-piece to be lifted; and means for connecting the U-shaped sheets of the driving means, comprising articulation pivots of the U-shaped sheet around an axis parallel to the plane of the sloped faces of the wedge.

2. The device of claim 1, wherein said articulation pivots of the U-shaped sheet around an axis parallel to the plane of the sloped faces of the wedge being secured in a housing integral with the U-shaped sheet located above this said U-shaped sheet.

3. The device of claim 1, wherein said driving means comprises a hydraulic ram.

4. The device of claim 1, wherein the U-shaped sheets are extended by tip-shaped plane sections thereby providing protection for the wedge during its travel.

5. The device of claim 1, wherein said connecting means comprises connecting rods.

6. The device of claim 7 further comprising:

elastic means for holding the U-shaped sheets in contact with the sloped faces of the wedge, preferably secured to the articulation pivots of the U-shaped sheets.

7. A device comprising:

a wedge-shaped internal part, both sloped faces of said wedge being covered by a channel, the internal face of which is in contact with the corresponding sloped face of the wedge that it covers;

means for driving the wedge between the two channels toward the items to be separated or the work-piece to be lifted;

means for connecting the channels of the driving means, comprising articulation pivots of the channel around an axis parallel to the plane of the sloped faces of the wedge; and wherein said articulation pivots of the channel around an axis parallel to the plane of the sloped faces of the wedge being secured in a housing integral with the channel located above this said channel.

8. The device of claim 7, wherein said driving means comprises a hydraulic ram.

9. The device of claim 7, wherein the channels are extended by tip-shaped plane sections thereby providing protection for the wedge during its travel.

10. The device of claim 7, wherein said connecting means comprises connecting rods.

11. The device of claim 7 further comprising:

elastic means for holding the channels in contact with the sloped faces of the wedge, preferably secured to the articulation pivots of the channels.

12. A device comprising:

a wedge-shaped internal part, both sloped faces of said wedge being covered by a channel, the internal face of which is in contact with the corresponding sloped face of the wedge that it covers;

means for driving the wedge between the two channels toward the items to be separated or the work-piece to be lifted;

means for connecting the channels of the driving means, comprising articulation pivots of the channel around an axis parallel to the plane of the sloped faces of the wedge; and wherein the channels are extended by tip-shaped plane sections thereby providing protection for the wedge during its travel.

13. The device of claim 12, wherein said driving means comprises a hydraulic ram.

14. The device of claim 12, wherein said connecting means comprises connecting rods.

15. The device of claim 12 further comprising:

elastic means for holding the channels in contact with the sloped faces of the wedge, preferably secured to the articulation pivots of the channels.

* * * * *